US005466485A

United States Patent [19]

Hsu

[11] Patent Number: 5,466,485

[45] Date of Patent: Nov. 14, 1995

[54] PROCESS FOR BATCH-PLATING ARAMID FIBERS

[75] Inventor: Che-Hsiung Hsu, Wilmington, Del.

[73] Assignee: E. I. du Pont de Nemours and Company, Wilmington, Del.

[21] Appl. No.: 380,530

[22] Filed: Jan. 30, 1995

[51] Int. Cl.[6] ..... B05D 1/00; B05D 3/10

[52] U.S. Cl. ..... 427/306; 427/443.1

[58] Field of Search ..... 427/306, 443.1, 427/434.6, 439, 256

[56] References Cited

U.S. PATENT DOCUMENTS

| | | | |
|---|---|---|---|
| 4,042,737 | 8/1977 | Forsgren et al. | 428/96 |
| 5,024,858 | 6/1991 | Burch | 427/123 |
| 5,302,415 | 4/1994 | Gabara et al. | 427/306 |
| 5,370,934 | 12/1994 | Burch et al. | 428/378 |
| 5,399,382 | 3/1995 | Burch et al. | 427/306 |
| 5,399,425 | 3/1995 | Burch | 428/328 |

*Primary Examiner*—Shrive Beck
*Assistant Examiner*—Brian K. Talbot

[57] ABSTRACT

A process is disclosed for batchwise metal plating aramid fibers wherein the fibers are knitted into a tube, plated, deknitted, reknitted into a tube, and plated again; and wherein the plating is durable and highly conductive.

18 Claims, No Drawings

PROCESS FOR BATCH-PLATING ARAMID FIBERS

BACKGROUND OF THE INVENTION

1. Field of the Invention

This invention relates to a process for efficient, batchwise, electroless metal plating of aramid fibers wherein the metal is strongly adhered to the aramid fiber substrate and provides a highly conductive surface.

2. Description of the Prior Art

Electroless plating is the deposition of a metal film by interaction of metal ions and a chemical reducing agent in a basic solution. Electroless plating, in a general way, is well known. One of the difficulties in achieving successful electroless plating has resided in obtaining good adhesion between the plating substrate and the plated metal. While mere encapsulation may suffice for some applications and some articles, good adhesion of the plated metal is essential for fiber surfaces because the plated metal coating must be durable enough to withstand the forces of further processing and end use stresses.

U.S. Pat. No. 5,302,415, issued Apr. 12, 1994, discloses a process for making electroless plated aramid surfaces by means of a preplating treatment using 80 to 90 weight percent aqueous sulfuric acid.

U.S. Ser. No. 08/261,074, which is commonly assigned discloses a process for plating aramid surfaces by using nitric acid or chlorosulfonic or fluorosulfonic acid as preplating treatment materials.

U.S. Pat. No. 4,042,737 discloses a process for the production of crimped, metal coated continuous filament yarns suitable for making antistatic fabrics by knitting the yarn, depositing a metal coating on the yarn, and then deknitting the yarn. There is indication that, while the coating is not uniform along the length of the yarn, it is adequately conductive to supply antistatic qualities for the purposes intended therein.

SUMMARY OF THE INVENTION

The present invention provides a process for efficient, batchwise, electroless plating of the entire surface of aramid fibers with a durable metal coating comprising the steps of: immersing the aramid fibers in an acid treatment liquid, washing the acid-immersed fibers with water until substantially all of the acid is removed, knitting the aramid fibers into a loose tube of material such that the surface of the fibers is exposed except at fiber crossover points in the knitted tube, contacting the fibers with a sensitizing solution, plating the fibers in a solution of metal cations to be plated, except at the fiber crossover points in the tube, deknitting the tube of plated fibers, reknitting the plated fibers into a loose tube of materials with the unplated fiber crossover points now exposed, and plating the aramid fibers of the reknitted tube, whereby, without additional acid immersion and without additional contact with the sensitizing solution, metal is evenly plated onto the entire surface of the aramid fibers. The acid treatment liquid can be selected from the group consisting of; 83 to 90% aqueous sulfuric acid, 86 to 91% aqueous nitric acid, 1 to 5% chlorosulfonic acid in an organic liquid, and 1 to 5% fluorosulfonic acid in an organic liquid and the treatment can be conducted for 2 to 60 seconds at a temperature in the range from 10° to 100° C.

DETAILED DESCRIPTION OF THE INVENTION

There has long been a need for an efficient, batchwise, process to make conductive aramid fibers which have durable metallic coatings.

One process which suggests itself for batchwise fiber processing, is the knit-deknit process. It has been known to treat fibers in a batchwise manner by loosely knitting the fibers into a tube before the treatment. After the treatment, the tube can be deknitted and the fibers can be reclaimed without tangles. Treatment of fibers in skeins often results in loss of fibers by entanglement.

Until recently, it was difficult to plate aramid fibers with durable metal coatings strongly adhered to the fibers. In the aforementioned U.S. Pat. No. 5,302,415, however, it is taught that metal can be electrolessly plated on aramid fibers by first immersing the fibers in a strong acid. That acid treatment is extreme and must be carefully controlled to avoid irreversible damage to the fibers. A part of that process also includes contact to the fibers with a sensitizing solution immediately after immersion in the acid.

When using the knit-deknit method of batchwise fiber handling, there is always a portion of the fibers which is inaccessible to some treatments. In a knitted structure, there are fiber crossover points where adjacent fibers in contact or in close juxtaposition shield each other from direct exposure to outside influences. For example, such shielding effectively eliminates a part of the fibers in a knitted structure from electroless metal plating. Knitted aramid fibers subjected to an electroless plating processing may be very well coated by metal on fibers which are exposed and directly accessible but will be coated little if any at fiber crossover points. When such aramid fibers are deknitted, they do not exhibit electrical continuity and their appearance is that of a partially coated material. The inventor herein conceived that such aramid fibers could be reknitted and plated a second time to coat the fiber surfaces which were missed in the first plating; but it seemed clear that the aramid fibers could not survive a second acid immersion without being damaged beyond utility. Additionally, it seemed likely that a second acid treatment would remove the previous metal coating from the first plating cycle. Moreover, it seemed evident that a second contact with the sensitizing solution would be necessary and, even if a second plating did coat the bare areas, it would also coat the previously-plated areas, thus resulting in an uneven metal coating.

The present invention resides in the discovery that aramid fibers which have been acid treated and knitted and plated, can be deknitted and reknitted and plated without a second acid treatment and without a second contact by sensitizing solution. The plating on the reknitted fibers is strongly adherent as though the fibers have been freshly acid treated and freshly contacted by the sensitizing solution; and the plating is evenly deposited to form a uniformly plated layer from the first-plated areas to the second-plated areas.

This invention provides a process for electrolessly batchwise plating of aramid fibers in a way that yields a plated fiber product of substantially maintained strength and modulus and a uniform metal coating which is highly conductive and strongly adherent.

By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. As a special case, it has been found that up to as much as 30 percent, by weight, of polyvinyl pyrrolidone can be included with poly(p-phenylene terephthalamide) in aramid fibers to be plated by the process of this invention.

Para-aramids are the primary polymers in fibers of this invention and poly(p-phenylene terephthalamide)(PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T and processes for spinning fibers from the PPD-T are described in U.S. Pat. Nos. 3,869,429; 4,308,374; and 4,698,414.

Meta-aramids may, also, be used in the fibers of this invention and poly(m-phenylene isophthalamide) (MPD-I) is the preferred meta-aramid. By MPD-I is meant the homopolymer resulting from mole-for-mole polymerization of m-phenylene diamine and isophthaloyl chloride and, also, copolymers resulting from incorporation of small amounts of other diamines with the m-phenylene diamine and of small amounts of other diacid chlorides with the isophthaloyl chloride. As a general rule, other diamines and other diacid chlorides can be used in amounts up to as much as about 10 mole percent of the m-phenylene diamine or the isophthaloyl chloride, or perhaps slightly higher, provided only that the other diamines and diacid chlorides have no reactive groups which interfere with the polymerization reaction. MPD-I, also, means copolymers resulting from incorporation of other aromatic diamines and other aromatic diacid chlorides, provided, only that the other aromatic diamines and aromatic diacid chlorides be present in amounts which do not interfere with the desired performance characteristics of the aramid.

As one step in the process of this invention, the aramid fibers to be plated are knitted into a loose tube. The knitting can be accomplished by any means, including any of several commercially-available tube knitting machines.

As another step in the process, the aramid fibers to be plated are contacted with acid at concentrations in solvents as disclosed herein. At acid concentrations above the prescribed limits, the solvating power of the acid is too high, causing damage to the fibers. At acid concentrations below the prescribed limits, the treatment time is excessively lengthened and no longer practical.

The temperature of the acid bath should be in the range from 10° to 100° C. and preferably about 20° C. to 40° C. The upper temperature limit is governed by the adverse effect on fiber tensile properties and filament fusion while the lower temperature limit is a matter of practicality; lower temperatures requiring unacceptably long times for adequate treatment.

The fibers, which can be of any desired thickness, are contacted with the acid solution for at least 2 seconds. With shorter exposure times it is difficult, ultimately, to achieve satisfactory depth of treatment. Longer exposure sometimes produces excessive cracking of the filaments and causes partial loss of tensile properties. As a general rule, soaking fibers in the acid for more than 60 seconds, even at moderate temperatures, results in degradation of the fibers. The preferred contact time is about 15–30 seconds. Exposure time to the acid can be reduced by increasing the temperature and/or increasing the acid concentration. Effective treatment of the fibers for practice of this invention requires a reasonable combination of acid concentration, temperature and soaking time. The treatment acid solutions are 83 to 90% aqueous sulfuric acid, 86 to 91% aqueous nitric acid, 1 to 5% chlorosulfonic acid in an organic liquid, and 1 to 5% fluorosulfonic acid in an organic liquid. Organic liquids eligible for use herein include any in which the acids are miscible and with which the acids to not react. Examples of such liquids include methylene chloride, hexane, cyclohexane, and the like.

The acid immersing step may cause microscopic cracks and other irregularities, such as morphological changes, to be formed through the aramid fiber surface. Although the acid-treated fibers may exhibit notch-like grooves and cracks along the axis of the fibers, a single acid treatment has been determined not to cause so much degradation that the fibers have lost their utility. On the other hand, two of such acid treatments would cause serious irreparable, degradation of the fibers.

The acid treated aramid fibers are washed well with water to remove substantially all of the acid. Optionally, the fibers can be neutralized with a base such as sodium bicarbonate solution which can be added to the wash water or used in a separate step. It is, also, possible to dry the acid-treated fibers prior to the plating step.

While it is preferred that the aramid fibers to be plated are knitted into tubes prior to being contacted with acid in the tube form, such is not necessary. The aramid fibers can, if desired, be contacted with the acid and washed before being knitted into tubes. The order of those steps is not critically important to the practice of this invention.

The washed fibers are then contacted with a sensitizing solution; and the sensitized fibers are plated. For an example of a copper plating process, an aqueous sensitizing solution, sometimes known as an activation bath, is prepared using palladium and tin cations as activation catalyst. The acid-immersed and washed aramid fibers to be plated are contacted with the sensitizing solution which is agitated to promote activation of the fiber surfaces. The fibers are, then, removed from the activation bath and rinsed and may, if desired, be transferred to an accelerator bath of dilute mineral acid.

The fibers are then placed in, or conducted through, a plating bath with copper ions and formaldehyde wherein the copper ions are complexed to maintain solution, for example, with tetrasodium salt of ethylenediamine tetraacetic acid (EDTA).

Baths having a wide range of metal concentrations can be used. The preferred plating baths are from about 1 to 5 grams per liter of copper. Baths of 1.5 to 3 grams per liter of copper are most preferred.

The plating bath, contacting activated aramid fibers in the knitted tubular form, is moderately agitated for 10 to 20 minutes to assure adequate pick-up. Formaldehyde, pH-adjusting caustic solution, and copper ion solution can be added at the rate of depletion. Additions ms can be made continuously or intermittently. The plated material can then be rinsed and dried. Instead of formaldehyde, other materials can be used as reducing agents. Among the eligible reducing agents are hypophosphite, hydrazine, boron hydride, and the like.

All of the above steps can be conducted with the various baths at temperatures of 10° to 60° C., and preferably 20°–40° C.

For an example of a silver plating process, the acid-immersed aramid fibers are first contacted by an aqueous sensitizing solution, sometimes known as a reducing agent solution such as $SnCl_2$/HCl. The $SnCl_2$-contacted fibers are rinsed with water extensively to remove excess stannous ions and are then transferred to an aqueous bath to which is added a metal complex solution of silver nitrate and ammonia at a bath pH of 8–9.5. During plating in the metal complex bath, the bath is agitated to ensure that imbibed stannous ions reduce silver ions to silver metal on the aramid surface. Formaldehyde is added to the metal complex solution as a reducing agent and silver ions preferentially deposit on the silver-activated aramid surfaces. In a typical process, the molar ratio of formaldehyde/silver is from 1.1/1 to 2/1. The amount of silver nitrate is adjusted to provide the desired weight of reduced silver as a function of the fiber material to be plated. The silver-plated fibers are rinsed and dried.

For the purposes of discussing this invention, the activation solution of tin-palladium for copper plating and the reducing solution of stannous ion for silver plating shall be known as sensitizing solutions. The sensitizing solutions are used in electroless plating to promote preferential metal deposition onto the desired surfaces.

Instead of silver or copper, nickel or cobalt or the like can be, also, plated on the acid-contacted fibers with a proper combination of sensitizing solution, reducing agent solution, and metal plating solution.

After plating the knitted tubes of aramid fibers, the tube is carefully deknitted and then reknitted into a similar tube. Visual inspection of the deknitted, once-plated, fibers reveals that there are small but regular locations on the fibers which have not been plated. Those unplated locations represent points where fibers crossed over one another in the knitted structure and were, therefore, inaccessible to the plating forces. Once deknitted, the fibers are knitted, again, into a loose tube and are plated to cover the unplated fiber locations.

This final plating can, quite surprisingly, be accomplished without either another acid treatment or additional contact with the sensitizing solution; and, when plated in that manner, the plating is adherent to the previously unplated fiber and is uniform over the length of the fiber from first-plated to second-plated areas.

The plating processes can be conducted on acid-immersed fibers which have been dried or which remain wet from washing of the acid-immersing step. In the case of copper plating, the plating quality appears to be relatively unaffected by drying the fibers after such washing. However, the silver plating process appears to yield plated silver of the lowest resistance when the fibers, first, are dried at about 15° to 80° C., preferably at 15° to 20° C. When the fibers to be silver plated are first dried at moderate temperature, there appears to be less silver metal impregnated into the fiber structure than occurs with undried fibers, and there appears to be better continuity of silver coating than is realized with fibers dried at higher temperatures.

TEST METHOD

Electrical Resistance

Electrical resistance of plated filaments is determined with a Keithley 173A electrometer and a resistance probe. One end of the probe has two pressure contact clips. The two clips are attached to the filament and separated one centimeter apart. The other end of the probe is connected to the electrometer for determination of resistance. The resistance reading is corrected for resistance of the probes and is reported as ohms per centimeter.

Electrical resistance of a plated yarn is determined by wrapping aluminum foil around the yarn at points about 30 centimeters (12 inches) apart and attaching metal clamps on the yarn at the inner ends of the aluminum foil wrapping. The electrical resistance along the yarn is determined using a Keithley 173A electrometer with probes attached to the clamps. The resistance reading is corrected for resistance of the clamps and is reported as ohms per 30 centimeters. Two readings are made. One in which the yarn is under no tension ("static") and another in which tension is applied to the yarn until there is no further change in resistance ("tension").

DESCRIPTION OF THE PREFERRED EMBODIMENTS

Examples 1 and 2 and Comparative Examples 1 and 2

Aramid fibers to be plated were immersed in 87.5 weight percent sulfuric acid for 30 seconds at a temperature of about 25° C. and then immediately washed with repeated changes of water until the acid was removed from the fibers. The aramid fibers were in a yarn of 444 dtex (400 denier) with 2.5 dtex per filament (2.25 denier per filament) made from poly(p-phenylene terephthalamide), and sold under the trademark designation Kevlar® 29 by E. I. du Pont de Nemours and Company. The washed yarn was then knitted into a tube using a Model LK-600 knitter, sold by L-R Machine Sales, Inc., Chickamauga, Ga. The knitter had a 9.5 centimeter (3.75 inch) diameter knitting head equipped with a 54 needles; and the stitching was set at about 550 courses and 390 wales. Courses are the number of stitches per meter along the tubing axis and wales are the number of stitches per meter around the tubing axis.

The tubing was cut into four smaller tubes for further processing and weighed for future reference. All of the tubes were contacted with a sensitizing solution for copper plating. The sensitizing solution was made using 1700 weight parts water, 540 weight parts of Cataprep® 404, and 60 weight parts of Cataposit® 44. Cataprep® 404 is a trademark designation of Shipley Co., 2300 Washington St., Newton, Mass., USA for a solution of 15 weight percent sodium bisulfate and 85 weight percent water and nonhazardous ingredients; and Cataposit® 44 is a trademark designation of Shipley Co. for a solution of 10 weight percent hydrochloric acid, 22 weight percent stannous chloride, less than 1 weight percent palladium, and 68 weight percent water and nonhazardous ingredients. Contact with the sensitizing solution was maintained for 10 minutes at 40° C. during which time the solution and the tubes were agitated. After removal from the sensitizing solution, the tubes were washed with water three times for five minutes.

All of the tubes of fibers were plated by immersing them in a copper plating solution at 40° C. and for times specified in Table 1 below. Because the comparison tubes were to be plated in only one step instead of two, the comparison tubes were immersed for twice as long as the tubes to be plated in accordance with this invention. The copper plating solution was made using 1476 weight parts water, 240 weight parts of Circuposit® 3350M, 84 weight parts of Circuposit® 3350A, and 200 weight parts of Circuposit® 3350B. Circuposit® 3350M is a trademark designation of Shipley Co. for a solution of 25 weight percent ethylenediamine tetraacetic acid and 75 weight percent water and nonhazardous materials; Circuposit® 3350A is a trademark designation of Shipley Co. for a solution of 7 weight percent formaldehyde, 10 weight percent copper sulfate, 3 weight percent hydrochloric acid, and 80 weight percent water and nonhazardous materials; and Circuposit® 3350B is a trademark designation of Shipley Co. for a solution of 5 weight percent sodium hydroxide, and 95 weight percent water and nonhazardous materials. After immersion in the copper plating solution for the prescribed times, the tubes were thoroughly washed with several changes of water, dried, and weighed to determine the weight of copper plated to the fibers of each tube. The weight of plated copper is shown in Table 1.

The tubes to be plated by the process of this invention were deknitted and the yarns were wound onto a cone using a windup machine. Those yarns were then reknitted using a KOMET® knitting machine sold by Scott & Williams, Laconia, N.H., U.S.A. The knitter had a 9 centimeter (3.5 inches) diameter knitting head equipped with 44 needles; and the stitching was set at about 236 courses and 512 wales.

The reknitted tubes were immersed in a copper plating solution with the same composition as was used previously at 40° C. and for times specified in Table 1. For this second plating step, there was no acid treatment and no contact with a sensitizing solution. The second-plated tubes were thoroughly washed with several changes of water, dried and weighed to determine the total weight of copper plated to the fibers of each tube. The weight of the plated copper is shown in Table 1. The tubes were deknitted and the fully plated yarns were wound to cones using a windup machine.

After the first plating, all of the fibers had noticeable, narrow and regularly-spaced bands of dark color mixed with the shiny copper color on the fiber surface. The bands of dark color originated as areas of fiber surface shielded from exposure by yarn cross-overs in the knitting structure; and were areas of still-active fiber sensitization despite the fact that the fibers had already been immersed for a considerable time in a plating solution. After the second plating, the dark bands were gone and the yarns had a uniform shiny copper appearance.

The plated fibers of this invention and the comparison fibers were analyzed for copper pick-up and tested for electrical resistance—static and under tension with results shown in Table 1.

TABLE 1

| | Plating Time (min) | Cu on Yarn (wt %)* | Electrical Resistance (ohms/30 cm)** static | tension |
|---|---|---|---|---|
| Example 1 | 25, first<br>25, second | 49.0 first<br>66.4 total | 2.7,2.5 | 1.4,1.4 |
| Comparison 1 | 50 | 63.6 | 18.9,14.7 | 3.7,3.9 |
| Example 2 | 35, first<br>35, second | 52.5 first<br>73.2 total | 1.6,1.3 | 1.0,1.0 |
| Comparison 2 | 70 | 63.7 | 61.9,20.7 | 7.5,3.6 |

*Weight percent based on weight of plated yarn.
**Duplicate test results reported As an illustration of copper coating homogeneity, 48 filaments were randomly removed from the yarn sample of Example 2 and were tested for electrical resistance over a 1 cm length. The average resistance of 42 filaments was 5.5 ohm/cm with a standard deviation of 1.4. The uniformity of metal coating was also confirmed by SEM cross-section photographs which showed that each filament was coated with copper all around the surface. On the contrary, the filaments from Comparative Example 2 had electrical resistances greater than 100 million ohms per centimeter, indicating a discontinuous metal coating.

Example 3 and Comparative Example 3

In these examples the same aramid yarn was used as was used in previous examples and portions of the yarn were given different acid treatments. The acid treatments utilized different concentrations of sulfuric acid, all for 25 seconds at 25° C. The acid concentrations are shown in Table 2.

The yarns were subjected to all of the washing, knitting, contacting with sensitizing solution, plating, deknitting, reknitting, and plating steps described in previous examples and were weighed and tested with results shown in Table 2. The copper plating time for the first and second round was 20 minutes. Inspection of the yarns between the first and second plating steps revealed that yarns which had undergone an acid treatment using sulfuric acid with a concentration of more than 82 weight percent had unplated cross-over areas which were very dark in color while those unplated areas in yarns untreated or treated in sulfuric acid of less than 82 weight percent were light colored or the yellow color of the original yarn. It was noted that sulfuric acid of 82 weight percent concentration yielded very nearly acceptable electrical resistance under the conditions of the example; and that 83 weight percent is certainly an adequate sulfuric acid concentration. It is believed that the dark color represents remaining activity of the sensitizing solution which is not washed off or deactivated in yarns having an adequate acid treatment before plating.

TABLE 2

| Examples | Acid Conc. (wt. %) | Cu on Yarn (wt. %) | Electrical Resistance (ohms/30 cm) static | tension |
|---|---|---|---|---|
| 3 | 87.5 | 70.5 | 1.3,1.3 | 0.9,1.0 |
| Comp. 3 | 82 | 66.4 | 57.0,74.0 | 6.9,9.3 |

Example 4 and Comparison Examples 4–6

In these examples, 444 dtex (400 denier) yarn with 1.67 dtex per filament (1.5 denier per filament) made from a combination of 85 weight percent poly(p-phenylene terephthalamide) and 15 weight percent poly(vinyl pyrrolidone) was treated with aqueous sulfuric acid at concentrations shown in Table 3 for 25 seconds at 25° C. The acid treated yarns and untreated Comparison 5 were carried through the rest of the experimental procedure. The copper plating time for the first round and second round was 20 minutes.

TABLE 3

| Examples | Acid conc. (wt. %) | Cu on Yarn (Wt. %) | Electrical Resistance (ohm/30 cm) Static | Tension |
|---|---|---|---|---|
| 4 | 87.5 | 72.9 | 2.0,2.2 | 1.5,1.4 |
| Comp. 4 | 30 | 65.0 | $>3 \times 10^8$ | 7.7 |
| | | | $>3 \times 10^8$ | 30.2 |
| Comp. 5 | None | 63.8 | $3 \times 10^8$ | 16.4 |
| | | | $1.7 \times 10^8$ | 18.6 |
| Comp. 6 | 70 | 62.0 | $>3 \times 10^8$ | $1.5 \times 10^8$ |
| | | | $>3 \times 10^8$ | 46.0 |

I claim:

1. In a process for batchwise electroless plating of the entire surface of aramid fibers with a durable metal coating comprising the steps of immersing the fibers in an acid treatment liquid, contacting the fibers with a sensitizing solution, and plating the fibers in a solution of metal cations to be plated;

the improvement which comprises, (a) immersing the aramid fibers for 2 to 60 seconds at a temperature in the range from 10° to 100° C. in an acid solution selected from the group consisting of; 83 to 90% aqueous sulfuric acid, 86 to 91% aqueous nitric acid, 1 to 5% chlorosulfonic acid in an organic liquid, and 1 to 5% fluorosulfonic acid in an organic liquid;

(b) washing the acid-immersed fibers with water until substantially all of the acid is removed;

(c) knitting the washed aramid fibers into a loose tube of material such that the surface of the fibers is exposed except at fiber crossover points in the knitted tube;

(d) contacting the knitted fibers with the sensitizing solution;

(e) plating the sensitized aramid fibers except at the fiber crossover points in the tube;

(f) deknitting the tube of plated fibers;

(g) reknitting the plated fibers into a loose tube of materials with unplated fiber crossover points now exposed;

(h) plating the aramid fibers of the reknitted tube, whereby, without additional acid immersion and without additional contact with the sensitizing solution, an evenly plated aramid fiber is produced.

2. The process of claim 1 wherein the aramid fibers are para-aramid.

3. The process of claim 2 wherein the para-aramid fibers are poly(p-phenylene terephthalamide).

4. The process of claim 1 wherein the aramid fibers are meta-aramid.

5. The process of claim 1 wherein the acid solution is 83 to 90% aqueous sulfuric acid.

6. The process of claim 1 wherein the acid solution is 86 to 91% aqueous nitric acid.

7. The process of claim 1 wherein the acid solution is 1 to 5% chlorosulfonic acid in an organic liquid or 1 to 5% fluorosulfonic acid in an organic liquid.

8. The process of claim 1 wherein the metal is copper.

9. The process of claim 8 wherein the sensitizing solution is a tin-palladium solution.

10. The process of claim 1 wherein the metal is silver.

11. The process of claim 10 wherein sensitizing solution is a stannous solution.

12. A process for batchwise electroless plating of the entire surface of aramid fibers with a durable metal coating comprising the steps of:

(a) immersing the aramid fibers for 2 to 60 seconds at a temperature in the range from 10 to 100° C. in an acid solution selected from the group consisting of; 83 to 90% aqueous sulfuric acid, 86 to 91% aqueous nitric acid, 1 to 5% chlorosulfonic acid in an organic liquid, and 1 to 5% fluorosulfonic acid in an organic liquid;

(b) washing the acid-immersed fibers with water until substantially all of the acid is removed;

(c) knitting the washed aramid fibers into a loose tube of material such that the surface of the fibers is exposed except at fiber crossover points in the knitted tube;

(d) contacting the knitted fibers with the sensitizing solution;

(e) plating the sensitized aramid fibers except at the fiber crossover points in the tube;

(f) deknitting the tube of plated fibers;

(g) reknitting the plated fibers into a loose tube of materials with unplated fiber crossover points now exposed;

(h) plating the aramid fibers of the reknitted tube, whereby, without additional acid immersion and without additional contact with the sensitizing solution, an evenly plated aramid fiber is produced.

13. The process of claim 12 wherein the aramid fibers are para-aramid.

14. The process of claim 13 wherein the para-aramid fibers are poly(p-phenylene terephthalamide).

15. The process of claim 12 wherein the aramid fibers are meta-aramid.

16. The process of claim 12 wherein the metal to be plated is selected from the group consisting of silver, copper, nickel, and cobalt.

17. The process of claim 12 wherein there is the added step of:

drying the washed fibers after the contacting of step (d).

18. The process of claim 17 wherein the drying is conducted at 15°–80° C.

* * * * *